US009472895B2

(12) United States Patent
Kataoka et al.

(10) Patent No.: US 9,472,895 B2
(45) Date of Patent: Oct. 18, 2016

(54) LEVER-TYPE CONNECTOR

(71) Applicant: Sumitomo Wiring Systems, Ltd., Yokkaichi, Mie (JP)

(72) Inventors: Shigeto Kataoka, Mie (JP); Norihito Hashimoto, Mie (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 14/823,005

(22) Filed: Aug. 11, 2015

(65) Prior Publication Data

US 2016/0064857 A1 Mar. 3, 2016

(30) Foreign Application Priority Data

Sep. 1, 2014 (JP) ..... 2014-177057

(51) Int. Cl.
*H01R 13/629* (2006.01)

(52) U.S. Cl.
CPC ..... *H01R 13/62938* (2013.01)

(58) Field of Classification Search
USPC ..... 439/157, 160, 159, 152; 29/758
See application file for complete search history.

(56) References Cited

U.S. PATENT DOCUMENTS 7,052,294 B1 * 5/2006 Osada ..... H01R 13/62955 439/157
7,407,396 B2 * 8/2008 Dillon ..... H01R 13/62933 439/157
7,448,888 B2 * 11/2008 Okano ..... H01R 13/4538 439/157
7,476,116 B2 * 1/2009 Shinozaki ..... H01R 13/62938 439/345
7,811,104 B2 * 10/2010 Matsumura ..... H01R 13/62955 439/157
8,353,712 B2 * 1/2013 Makino ..... H01R 13/62938 439/157
8,403,697 B2 * 3/2013 Fukamachi ..... H01R 13/62938 439/157
9,018,550 B2 * 4/2015 Kobayashi ..... H01H 9/0066 200/50.01

FOREIGN PATENT DOCUMENTS

JP 2008-027787 2/2008

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A lever-type connector includes a housing (10) connectable to a mating housing, and a lever (60) mounted on the housing (10) rotatably between an initial position and a connection position. The housing (10) includes a fixing portion (21) to be fixed to a fixing surface (91) and reinforcing portions (24) integrally coupled to the fixing portion (21) and configured to reinforce the fixing portion (21). The reinforcing portions (24) additionally have a function as a stopper for regulating the rotation of the lever (60) in a direction opposite to a direction toward the connection position by contact with the lever (60) at the initial position.

8 Claims, 5 Drawing Sheets

LEVER-TYPE CONNECTOR

BACKGROUND

1. Field of the Invention

The present invention relates to a lever-type connector.

2. Description of the Related Art

Japanese Unexamined Patent Publication No. 2008-27787 discloses a lever-type connector that has a female housing and a cover assembled with the female housing. A lever is mounted on the housing for rotation between an initial position and a rotation end position (connection position). The female housing is connectable to a male housing. The lever is engaged with the male housing at the initial position and connects the two housings during rotation from the initial position to the rotation end position to bring the two housings into a properly connected state at the rotation end position. A second regulating portion is formed on a side surface of the cover and the lever is formed with an open round hole. Rotation of the lever from the initial position toward the connection position and in an opposite direction is regulated by fitting the second regulating portion into the round hole at the initial position.

The housing of the above conventional lever-type connector has a dedicated stopper called a second regulating portion to regulate rotation of the lever in the direction opposite to the direction toward the connection position. The configuration becomes complicated by the second regulating portion and there are many design constraints caused by the second regulating portion.

The invention was completed based on the above situation and aims to provide a lever-type connector having few constraints in design and a simple structure for regulating the rotation of a lever in a direction opposite to a direction toward a connection position.

SUMMARY

The invention is directed to a lever-type connector, including a housing connectable to a mating housing. A lever is mounted on the housing for rotation between an initial position and a connection position. The lever is configured to engage the mating housing during rotation from the initial position to the connection position and to bring the two housings into a properly connected state at the connection position. The housing includes a fixing portion to be fixed to a fixing surface and a reinforcing portion integrally coupled to the fixing portion and configured to reinforce the fixing portion. The reinforcing portion also functions as a stopper for regulating the rotation of the lever in a direction opposite to a direction toward the connection position by contact with the lever at the initial position.

Since the reinforcing portion functions to reinforce the fixing portion and to regulate the reverse rotation of the lever (rotation of the lever in the direction opposite to the direction toward the connection position). Thus, it is not necessary to provide a dedicated stopper for regulating the reverse rotation of the lever, a structure can be simplified and constraints in design can be reduced.

The housing may include an auxiliary portion integrally and continuously extending from the fixing portion and the reinforcing portion projects in a direction intersecting an extending direction of the auxiliary portion from the fixing portion. If the stopper for regulating the reverse rotation of the lever is in the form of an independent projection, the above-described auxiliary portion is at a position facing a mold for molding the stopper in a mold pull-out direction and it becomes difficult to mold the auxiliary portion is difficult to mold. However, the auxiliary portion of the invention projects in the direction intersecting with the extending direction of the auxiliary portion from the fixing portion and the reinforcing portion is not an independent projection, so that the auxiliary portion can be molded easily.

DETAILED DESCRIPTION

A lever-type connector of this embodiment includes a housing 10 made of synthetic resin and a lever 60 made of synthetic resin and mounted on the housing 10 for rotation between an initial position and a connection position. The housing 10 is connectable to an unillustrated mating housing. Note that, in the following description, a surface on which the housing 10 is facing the mating housing at the time of starting a connection is referred to as a front side concerning a front-back direction and a vertical direction is based on FIGS. 3 and 4.

Figure 1:
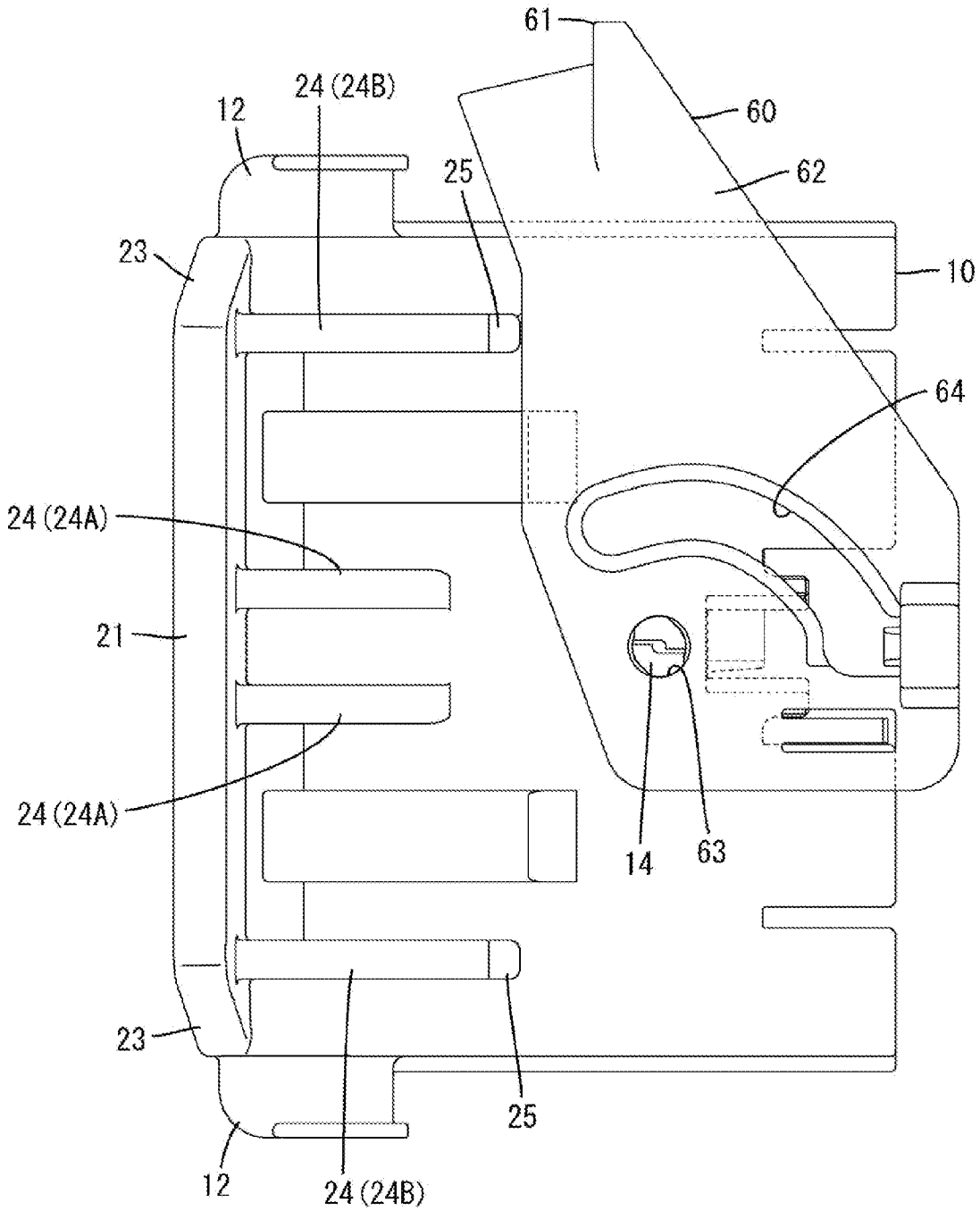
FIG. 1 is a plan view showing a state where a lever is left at an initial position with respect to a housing in a lever-type connector according to an embodiment of the present invention.
Figure 2:
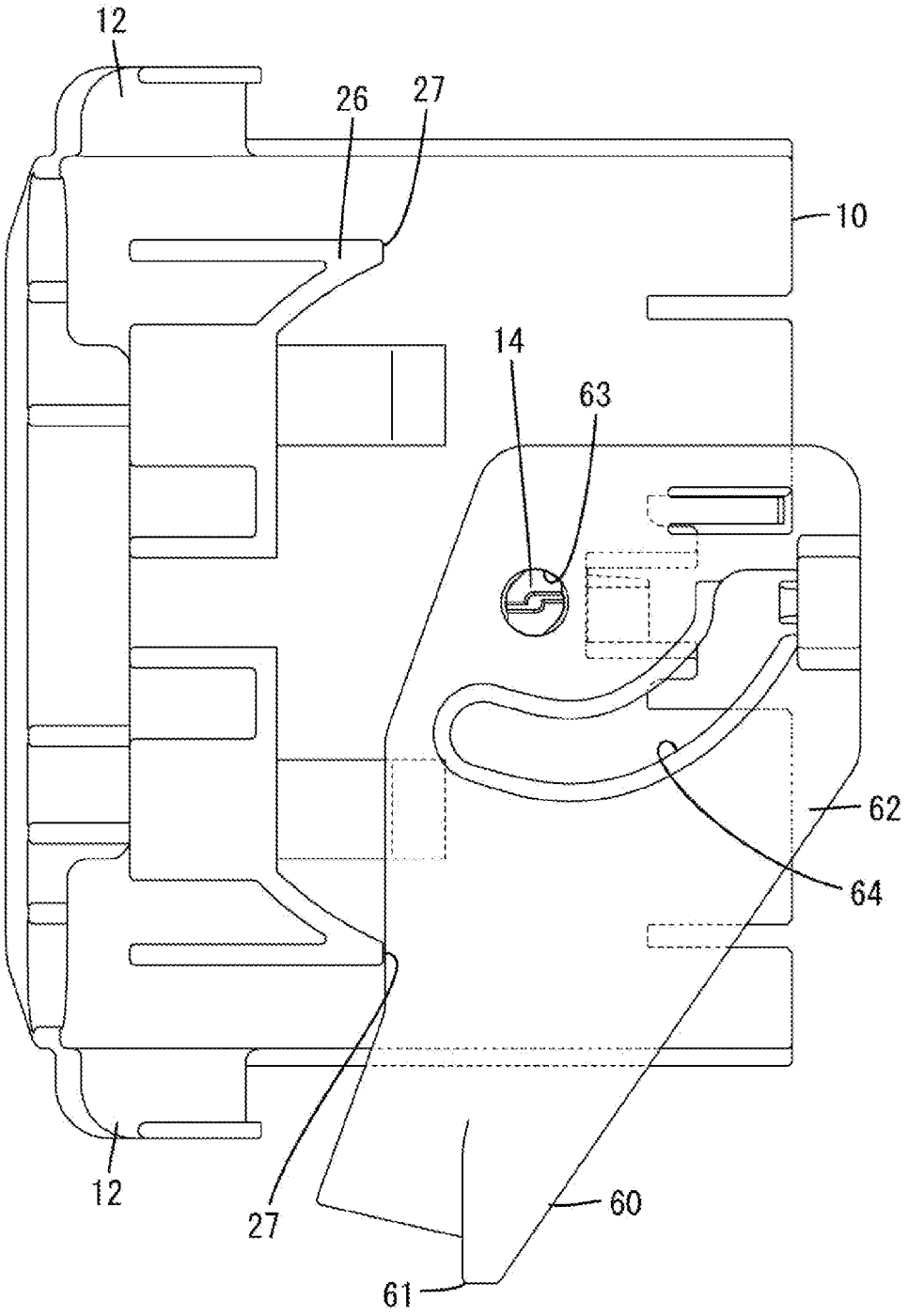
FIG. 2 is a bottom view showing the state of FIG. 1.
Figure 3:
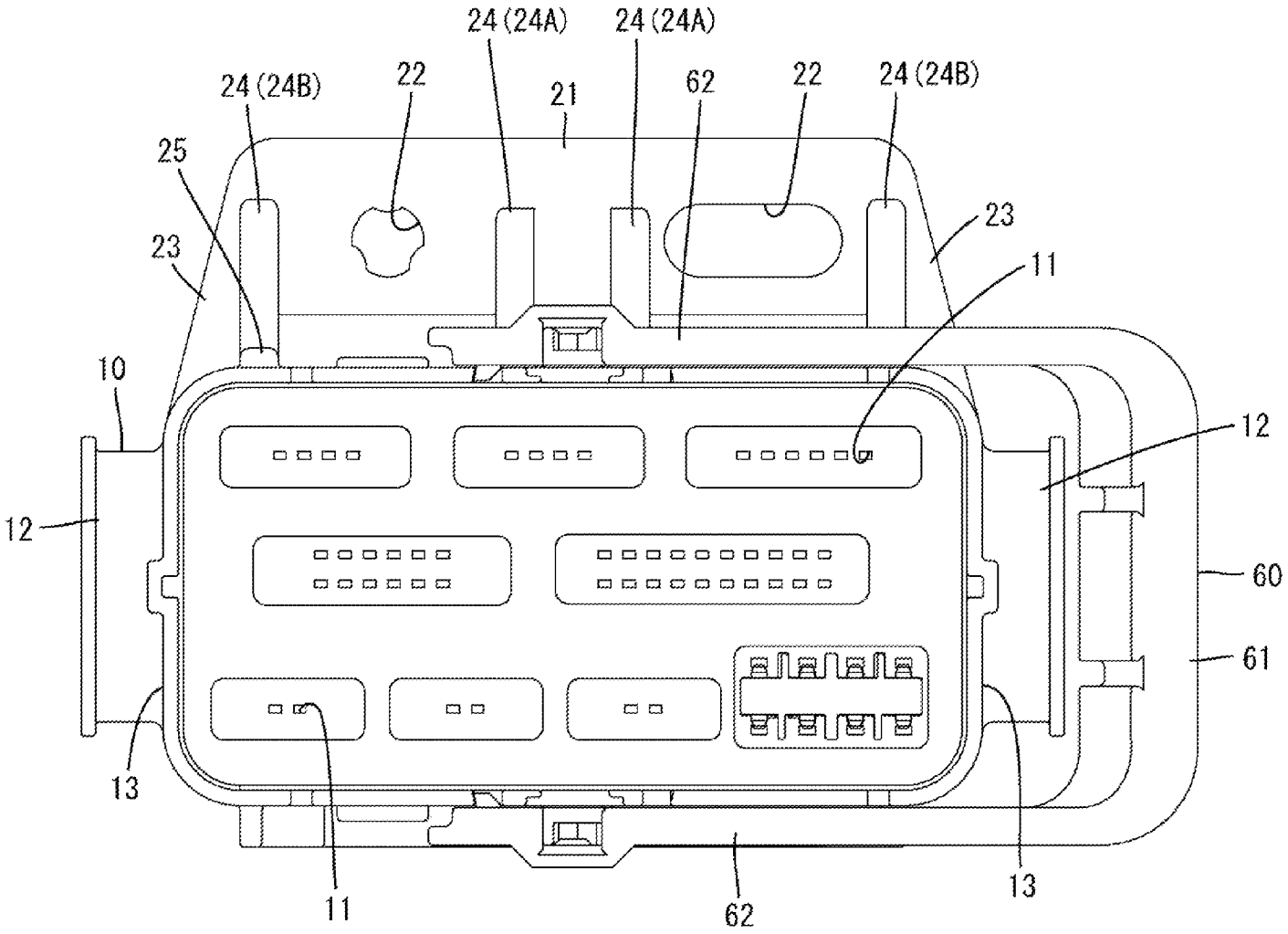
FIG. 3 is a front view showing the state of FIG. 1.
Figure 4:
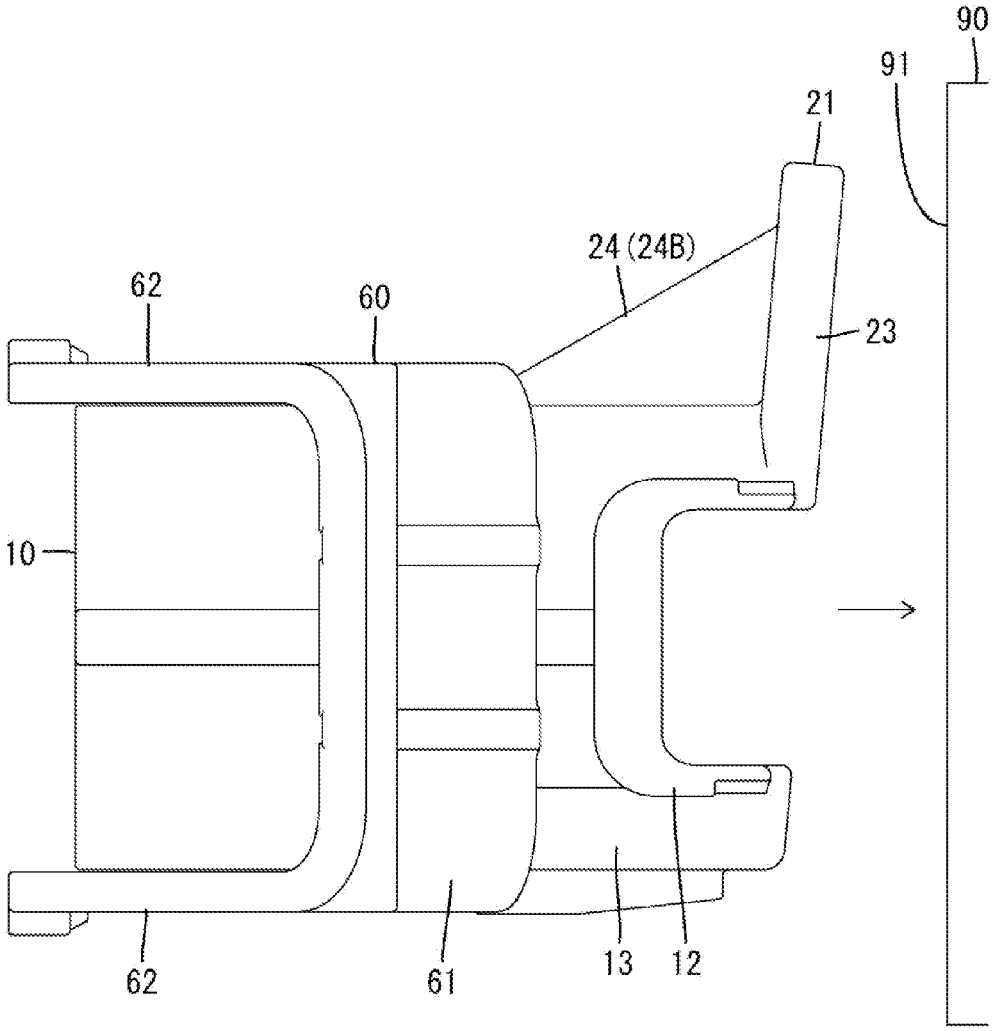
FIG. 4 is a side view showing the state of FIG. 1.
Figure 5:
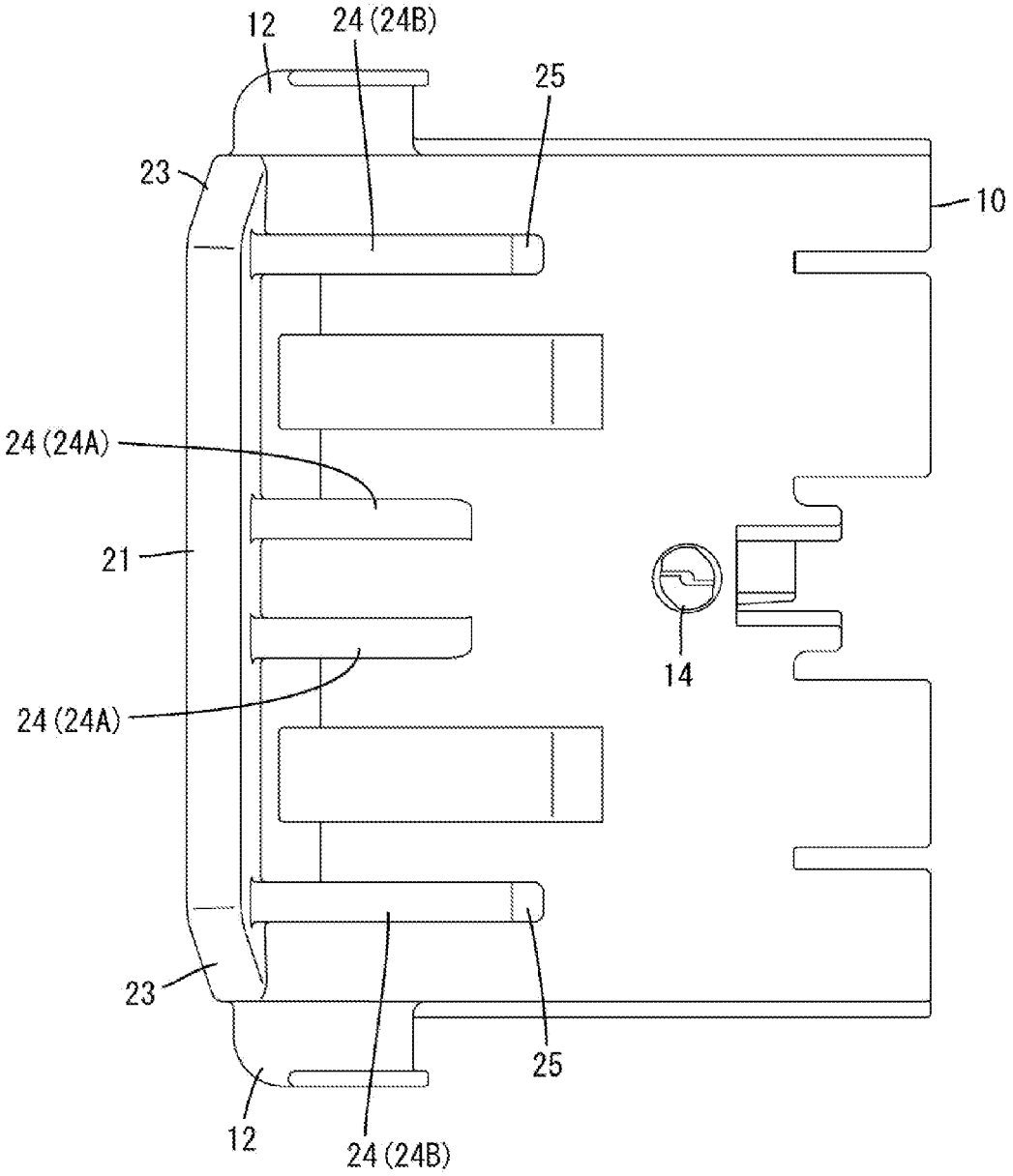
FIG. 5 is a plan view of the housing.

As shown in FIG. 3, terminal insertion holes 11 are provided in the housing 10 for receiving unillustrated terminal fittings. Two wire draw-out portions 12 are provided on opposite left and right side walls 13 of the housing 10 through which unillustrated wires connected to the terminal fittings can be drawn out. As shown in FIG. 4, the wire draw-out portion 12 is a bent wall having a substantially U-shaped cross-section, projecting sideways while being recessed on the rear end of the side wall 13 and open backward. As shown in FIGS. 1, 2 and 5, two supporting shafts 14 project in laterally central parts of opposite upper and lower surfaces of the housing 10. The supporting shaft 14 is substantially cylindrical and rotatably supports the lever 60.

As shown in FIG. 3, the lever 60 includes a coupling 61 extending in the vertical direction and two cam plates 62 projecting substantially parallel to each other from opposite upper and lower ends of the coupling 61. As shown in FIGS. 1 and 2, a bearing 63 penetrates through the cam plate 62 and receives the supporting shaft 14. The lever 60 is mounted to straddle the housing 10 and is rotatable about the supporting shafts 14 with the supporting shafts 14 fit in the bearing portions 63. Further, the cam plate 62 has a cam groove 64 extending in a curved manner and opens on the outer peripheral edge of the cam plate 62.

As shown in FIGS. 1 to 3, the coupling portion 61 is arranged to project laterally of the housing 10 and the entrances of the cam grooves 64 are open forward when the lever 60 is at the initial position. If the housing 10 is lightly connected to the mating housing in that state, unillustrated cam followers provided on the mating housing enter the entrances of the cam grooves 64. If the lever 60 is rotated from the initial position toward the connection position in that state while the coupling portion 61 is gripped, the cam followers slide along groove surfaces of the cam grooves 64 and the connection of the two housings proceeds by a cam mechanism acting between the lever 60 and the mating housing. At the connection position, the cam followers reach back end parts of the cam grooves 64 and the two housings are brought into a properly connected state. By bringing the two housings into the properly connected state in this way, the respective unillustrated terminal fittings accommodated in the housing 10 are electrically connected to unillustrated mating terminal fittings accommodating in the mating housing.

As shown in FIGS. 1 and 3 to 5, a fixing portion 21 projects on a rear end part of the upper surface of the housing 10. The fixing portion 21 is in the form of a plate laterally extending along the rear end of the upper surface of the housing 10. The fixing portion 21 is substantially rectangular in a front view (see FIG. 3), and projects back from the rear end of the upper surface of the housing 10 while being inclined somewhat up (see FIG. 4). As shown in FIG. 3, left and right fixing holes 22 penetrate through the fixing portion 21. The fixing hole 22 on the right side in FIG. 3 is an oblong hole long in a lateral direction. The fixing portion 21 is arranged along a fixing surface 91 (see FIG. 4) of a mounting member 90 and, in that state, unillustrated bolts are inserted into the fixing holes 22 and tightened to fix the fixing portion 21 to the mounting member 90. Note that, by fixing the fixing portion 21 to the mounting member 90, rear end openings of the wire draw-out portions 12 are closed and the unillustrated wires are laid along the fixing surface 91.

Further, as shown in FIGS. 1 and 3 to 5, two auxiliary portions 23 project integrally on the rear end part of the upper surface of the housing 10 and extend sideways from opposite left and right ends of the fixing portion 21. The auxiliary portion 23 are triangular plates in a front view whose height is gradually reduced toward an end edge of the upper surface of the housing 10 and is continuous and flush with opposite front and rear surfaces of the fixing portion 21 without any step.

As shown in FIGS. 1 and 3 to 5, reinforcing portions 24 project forward from the front surface of the fixing portion 21 and are coupled integrally to the front surface of the fixing portion 21. The reinforcing portions 24 extend in an extending direction of the auxiliary portions 23 from the fixing portion 21. The reinforcing portions 24 are coupled integrally to the fixing portion 21, whereby the fixing portion 21 is reinforced and deformation during bolt tightening is avoided.

Specifically, as shown in FIGS. 1, 3 and 5, the reinforcing portions 24 are composed of a pair of central-side reinforcing portions 24A arranged near a lateral center of the upper surface of the housing 10 and a pair of end-side reinforcing portions 24B arranged near opposite left and right ends of the upper surface of the housing 10. The reinforcing portion 24 is in the form of a plate substantially triangular in a side view whose height is gradually increased from a front end part to the rear end thereof. In a front view, the supporting shaft 14 is arranged between the both central-side reinforcing portions 24A and the fixing holes 22 are arranged between the central-side reinforcing portions 24 and the end-side reinforcing portions 24B. The end-side reinforcing portions 24B are formed one size larger than the central-side reinforcing portions 24A, the front ends thereof are arranged before those of the central-side reinforcing portions 24A and the upper ends thereof are arranged above those of the central-side reinforcing portions 24A. The central-side reinforcing portions 24A are hidden behind the end-side reinforcing portion 24B in a side view (see FIG. 4). The upper ends (rear ends) of the end-side reinforcing portions 24B are arranged at a position lower than the upper end of the fixing portion 21. Further, the end-side reinforcing portion 24B is coupled to a boundary part where the fixing portion 21 and the auxiliary portion 23 are connected to each other. As shown in FIGS. 1, 3 and 5, the front end of the end-side reinforcing portion 24B is configured as a stopper portion 25 in the form of a projecting rib. The stopper portion 25 is connected to an upper end inclined surface of the end-side reinforcing portion 24B in a stepped manner.

As shown in FIG. 2, an attachment portion 26 formed to be flat along the lateral direction projects on a rear end part of the lower surface of the housing 10. Opposite left and right end parts of the attachment portion 26 project forward and the front ends of the projecting parts are configured as auxiliary stopper portions 27 in the form of projecting ribs.

As shown in FIG. 1, the rear end edge of one cam plate 62 (upper cam plate 62 in FIG. 1) is arranged in contact with the stopper portion 25 of the end-side reinforcing portion 24B when the lever 60 is at the initial position. Accordingly, even if an attempt is made to rotate the lever 60 in a direction (backward direction) opposite to the direction from the initial position toward the connection position, any further rotation of the lever 60 is obstructed by the contact of the one cam plate 62 with the stopper portion 25. That is, according to this embodiment, the reverse rotation of the lever 60 is regulated by the reinforcing portion 24. Further, as shown in FIG. 2, the rear end edge of the other cam plate 62 (lower cam plate 62 in FIG. 2) is arranged to be able to come into contact with the auxiliary stopper portion 27 of the attachment portion 26. The reverse rotation of the lever 60 is auxiliary regulated also by this.

On the other hand, if the lever 60 is rotated from the initial position toward the connection position, the one cam plate 62 is separated from the stopper portion 25 and the other cam plate 62 is separated from the auxiliary stopper portion 27, whereby the lever 60 is smoothly brought to the connection position. Note that, in the case of this embodiment, the lever 60 can be mounted on the supporting shafts 14 of the housing 10 in a posture opposite to the shown posture (posture in which the coupling portion 61 is arranged on a lower side in FIG. 1). In such a case, the lever 60 comes into contact with another stopper portion 25 and another auxiliary stopper portion 27 located on a side opposite to the above stopper portion 25 and auxiliary stopper portion 27, whereby the reverse rotation of the lever 60 is regulated.

As described above, according to this embodiment, the reinforcing portions 24 have both a function of reinforcing the fixing portion 21 and a function of regulating the reverse rotation of the lever 60. Thus, it is not necessary to provide a dedicated stopper for regulating the reverse rotation of the lever 60, the overall configuration can be simplified and constrains in design can be reduced.

Further, the housing 10 includes the auxiliary portions 23 integrally and continuously extending from the fixing portion 21 and the reinforcing portions 24 project in a forward direction intersecting with the lateral direction, which is an extending direction of the auxiliary portions 23 from the fixing portion 21. Thus, unlike a case where the reinforcing portions 24 independently project, the auxiliary portions 23 are not arranged at positions facing a mold for molding the reinforcing portions 24 in a mold pull-out direction and the auxiliary portions 23 can be easily molded.

The lever may be in the form of a single plate.

The lever may be structured to proceed with the connection of the two housings by a force multiplying mechanism utilizing a rack and a pinion or a lever.

A structure may be adopted in which the reverse rotation of the lever is regulated by contact of the coupling portion of the lever with the reinforcing portion.

A structure may be adopted in which reverse rotation of the lever is regulated by contact of the lever with the central-side reinforcing portion.

The housing falls under a concept including a cover and a case and the lever may be structured to be mounted rotatably on the cover or the case.

The lever may be arranged in proximity to the reinforcing portion without contacting the reinforcing portion when the lever is at the initial position and the lever may contact the reinforcing portion to obstruct any further rotation of the lever when an attempt is made to rotate the lever in the opposite direction.

The auxiliary stoppers may be omitted from the housing and the function of regulating the reverse rotation of the lever may be provided only by the stopper of the reinforcing portion.

LIST OF REFERENCE SIGNS

10 . . . housing
21 . . . fixing portion
23 . . . auxiliary portion
24 . . . reinforcing portion
24A . . . central-side reinforcing portion
24B . . . end-side reinforcing portion
25 . . . stopper portion
60 . . . lever
62 . . . cam plate
90 . . . mounting member
91 . . . fixing surface

What is claimed is:

1. A lever-type connector, comprising:

a housing having a rear end and a front end spaced from the rear end along a connecting direction, opposite side surfaces extending between the front and rear ends, the front end being connectable to a mating housing; and a lever mounted on at least one of the side surfaces of the housing rotatably between an initial position and a connection position and configured to proceed with the connection of the housings while being engaged with the mating housing in a rotation process from the initial position to the connection position and bring the two housings into a properly connected state at the connection position, wherein:

the housing includes a fixing portion projecting out from the at least one side surfaces on which the lever is mounted at a position adjacent the rear end and configured to be fixed to a fixing surface and a reinforcing portion integrally coupled to the fixing portion and extending forward along the side surface, the reinforcing portion being configured to reinforce the fixing portion; and the reinforcing portion has a stopper projecting out from the side surface at a position forward of the fixing portion for regulating rotation of the lever in a direction opposite to a direction toward the connection position by contact with the lever at the initial position.

2. The lever-type connector of claim 1, wherein the housing includes an auxiliary portion integrally and continuously extending from the fixing portion and the reinforcing portion projects in a direction intersecting an extending direction of the auxiliary portion from the fixing portion.

3. The lever-type connector of claim 1, wherein the lever is substantially U-shaped and has two substantially parallel cam plates mounted respectively to the opposite side surfaces of the housing.

4. The lever-type connector of claim 1, wherein the reinforcing portion defines a plane that extends substantially parallel to the connecting direction.

5. The lever-type connector of claim 1, wherein the reinforcing portion has an outer edge remote from the side surface of the housing, the outer edge being sloped toward the side surface of the housing at farther distances from the fixing portion.

6. The lever-type connector of claim 5, wherein the stopper is at an end of the reinforcing portion remote from the fixing portion.

7. The lever-type connector of claim 4, wherein the stopper is at an end of the reinforcing portion remote from the fixing portion.

8. The lever-type connector of claim 1, wherein the fixing portion is formed with mounting holes for mounting in the lever-type connector to a mounting member.

* * * * *